US009060590B2

(12) United States Patent
Valesko

(10) Patent No.: US 9,060,590 B2
(45) Date of Patent: Jun. 23, 2015

(54) BACKPACK FRAME

(71) Applicant: Joseph Ethan Valesko, Palm Bay, FL (US)

(72) Inventor: Joseph Ethan Valesko, Palm Bay, FL (US)

( * ) Notice: Subject to any disclaimer, the term of this patent is extended or adjusted under 35 U.S.C. 154(b) by 196 days.

(21) Appl. No.: 13/917,724

(22) Filed: Jun. 14, 2013

(65) Prior Publication Data

US 2014/0367439 A1 Dec. 18, 2014

(51) Int. Cl.

| | |
|---|---|
| ***A45F 3/08*** | (2006.01) |
| *A45F 3/10* | (2006.01) |
| *A45F 3/14* | (2006.01) |
| *A45F 3/04* | (2006.01) |
| *A45F 3/00* | (2006.01) |

(52) U.S. Cl.

CPC ... *A45F 3/08* (2013.01); *A45F 3/10* (2013.01); *A45F 3/14* (2013.01); *A45F 3/047* (2013.01); *A45F 3/00* (2013.01)

(58) Field of Classification Search

CPC ..... A45F 3/00; A45F 3/08; A45F 3/10; A45F 3/04; A45F 3/14; A45F 3/047

See application file for complete search history.

(56) References Cited

U.S. PATENT DOCUMENTS

| | | | | |
|---|---|---|---|---|
| 954,825 | A | 4/1910 | Schumacker | |
| 3,347,429 | A | 10/1967 | Ruth, Jr. | |
| 3,889,859 | A * | 6/1975 | Joseph | 224/634 |
| 4,015,759 | A * | 4/1977 | Dreissigacker et al. | 224/262 |
| 4,479,595 | A * | 10/1984 | Opsal | 224/630 |
| 5,904,282 | A * | 5/1999 | Gleason | 224/635 |
| 5,971,244 | A | 10/1999 | Jaeger | |
| 6,179,188 | B1 * | 1/2001 | Gleason | 224/641 |
| 6,199,731 | B1 * | 3/2001 | Lehoux | 224/260 |
| 6,607,108 | B2 * | 8/2003 | Mydans | 224/630 |
| 6,626,342 | B1 * | 9/2003 | Gleason | 224/633 |
| 7,232,048 | B2 * | 6/2007 | Le Gal et al. | 224/201 |
| 7,770,769 | B2 * | 8/2010 | Hurn | 224/631 |
| 2003/0121942 | A1 * | 7/2003 | Chang | 224/260 |
| 2006/0208024 | A1 * | 9/2006 | Gleason | 224/633 |
| 2009/0015022 | A1 * | 1/2009 | Rome et al. | 290/1 A |
| 2010/0032464 | A1 * | 2/2010 | Gleason, Jr. | 224/631 |
| 2010/0252594 | A1 * | 10/2010 | Basenberg et al. | 224/259 |
| 2011/0011903 | A1 * | 1/2011 | Buffinton et al. | 224/191 |
| 2013/0043291 | A1 * | 2/2013 | Davis, Jr. | 224/578 |

* cited by examiner

*Primary Examiner* — Brian D Nash
(74) *Attorney, Agent, or Firm* — Kelly G. Swartz; Widerman Malek, PL

(57) ABSTRACT

A backpack frame comprising a plurality of flexible support members wherein each of the plurality of flexible support members further comprise a top end and a bottom end, a pack further comprising a first tensioner attachment point and a second tensioner attachment point, and a plurality of tensioners wherein each of the plurality of tensioners further comprises a tension length. One of the plurality of tensioners is attached to the first tensioner attachment point and also attached to the second tensioner attachment point. One of the plurality of flexible support members extends substantially between the first tensioner attachment point and the second tensioner attachment point. The tension length of one of the plurality of tensioners is located between the first tensioner attachment point and the second tensioner attachment point. The tension length may be adjusted.

9 Claims, 5 Drawing Sheets

BACKPACK FRAME

FIELD OF THE INVENTION

The present invention relates to the field of backpack frames. More specifically, the present invention relates to lightweight backpack frames that include flexible supports that may bow under tension.

BACKGROUND OF THE INVENTION

Backpack frames have traditionally been rigid structures to which a pack is secured. Traditional backpack frames distribute the load of the pack to the wearer's hips and bring the pack in contact with the wearer's back. This construction has been unsatisfactory as it is uncomfortable for the wearer to have the pack in contact with his or her back. The close proximity of the pack to the wearer's back prevents air from circulating in the area and cooling the wearer. Additionally, the contents of the pack may exert pressure on the wearer's back causing additional discomfort for the wearer.

Another difficulty with these prior backpack frames is that they are generally complex in structure and expensive to manufacture. Since these frames are generally constructed of materials that are permanently secured together, the frame cannot be reduced in size for storage or flattened for easier transport or storage.

It is therefore an object of my invention to provide a backpack frame that may be easily assembled and disassembled in the field without special tools, that may be easily flattened for storage or transport, and that, when applied to the back of a wearer, will avoid any hard surface contact with the body while at the same time distributing the weight of the pack to the wearer's hips.

SUMMARY OF THE INVENTION

With the foregoing in mind, embodiments of the present invention are related to a lightweight, adjustable backpack frame. Furthermore, the backpack frame may advantageously combine flexible support stays with an adjustable tensioner.

According to an embodiment of the present invention, a backpack frame may be constructed from a pair of flexible support members with tensioners attached to each end of the flexible support members. These flexible support members may be constructed of a material that flexes. Specifically, the flexible support members may be constructed of a lightweight material that resiliently flexes when exposed to stress. The flexible support members may remain rigid when exposed to forces that extend through the flexible support member substantially perpendicular to the top end and the bottom end. The flexible support members may flex or bow into an essentially arcuate shape when exposed to lateral forces that deflect the area of the flexible support member disposed between the top end and the bottom end while applying force to bring the top end and the bottom end in closer proximity to one another. When these forces are removed, the flexible support member may return to its original, essentially planar shape.

Each flexible support member may be connected to a pack by a top capture and a bottom capture. The top capture or the bottom capture may be a rivet or any fastener known to those skilled in the art. In one embodiment, the top capture or bottom capture may be constructed from ruggedized fabric that is secured to the pack on the left side and the right side of the flexible support member. In another embodiment, the top capture or bottom capture may be constructed from ruggedized fabric that is secured to the pack on the left side and the right side of the flexible support member as well as above the top end for a top capture and below the bottom end for a bottom capture. The top capture or bottom capture may removably connect the flexible support member to the pack. This may be achieved by connection methods including, but not limited to, hooks and loops, snaps, rivets, buttons, zippers, securing pockets, or the like.

A tensioner attachment point may be disposed on the pack. The tensioner attachment point may be disposed in close proximity to each top end and each bottom end. The tensioner attachment point may connect to the pack at the same location as the top capture or bottom capture. Two tensioner attachment points may be disposed on the pack for each flexible support member that is present.

A tensioner may connect to two tensioner attachment points. The tensioner may be a rope-like structure constructed from a synthetic material that resists elongation when subject to tensile stress. The tensioner may have a tension length that is measured as the length of tensioner disposed between the two tensioner attachment points to which the tensioner is connected.

The tensioner length may be adjusted to manipulate the shape of the flexible support member across which the tensioner is disposed. When the tensioner length is at maximum length, which is any length longer than the length of the flexible support member across which the tensioner is disposed, the flexible support member may maintain a substantially planar shape. When the tensioner length is adjusted to an activating length, which is any length shorter than the length of the flexible support member across which the tensioner is disposed, the flexible support member may be subject to forces that draw the top end and the bottom end closer together and cause the flexible support member to assume an arcuate shape.

In one embodiment of the inventive backpack frame there may be two flexible support members, two tensioners, two top captures, two bottom captures, and four tensioner attachment points. In such an embodiment, the tension length of each tensioner may be adjusted independently. In such an embodiment, the two flexible support members may be disposed substantially parallel to one another. The two flexible support members may be substantially identical in length. The top captures may be disposed at substantially the same height on the pack and the bottom captures may be disposed at substantially the same height on the pack.

The tensioner may be connected to the tensioner attachment point by threading the tensioner through a first opening of an attachment apparatus and a second opening of an attachment apparatus. The tensioner may pass through the first opening substantially 180° opposed to the direction at which it may pass through the second opening. The tensioner may be secured in place by the attachment apparatus through friction, clamping, or the like. The tensioner length may be adjusted by pulling on either free end of the tensioner. The force exerted by the attachment apparatus may be removed from the tensioner to allow the tension length to increase.

A cross-member may extend between two or more flexible support members. In embodiments utilizing a cross-member, the cross-member may connect substantially orthogonally to each flexible support member. The cross-member may be constructed from a material similar to that of the flexible support member. However, it may not be necessary for the cross-member to flex. The cross-member may be resiliently flexible or rigid. In some embodiments of the inventive backpack frame, a cross-member may connect two flexible support members at or near the top ends while a second cross-member may connect the two flexible support members at or around their mid-points.

A mesh structure may extend substantially between two or more tensioners. The mesh structure may be substantially planar and provide a breathable surface to come into contact with a wearer's back when the backpack is in use.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
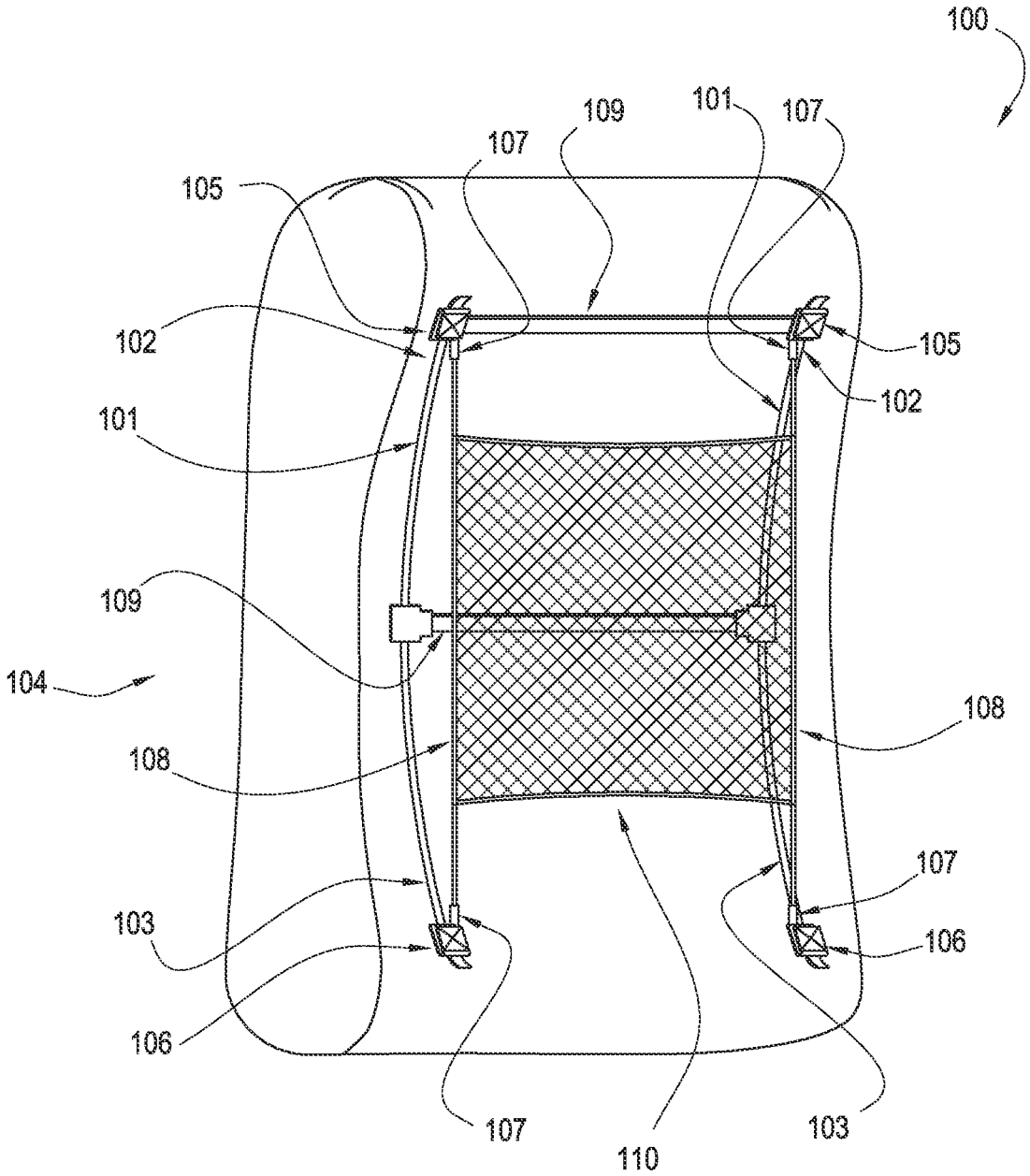
FIG. 1 is a perspective drawing of the backpack frame.

Referring to FIG. 1, a backpack frame 100 is shown. As depicted, there is a pair of flexible support members 101. These flexible support members 101 may be constructed of a material that flexes. Specifically, the flexible support members 101 may be constructed of a lightweight material that resiliently flexes when exposed to lateral stress. Suitable materials for the flexible support members include, but are not limited to, carbon fiber, aluminum, wood, or the like. In one embodiment of the inventive concept, the flexible support members 101 may be constructed from carbon fiber rods, blades, or the like. The flexible support members 101 may be solid or hollow.

Each flexible support member 101 may have a top end 102 and a bottom end 103. The flexible support members 101 may remain rigid when exposed to forces that extend through the flexible support member 101 directly between the top end 102 and the bottom end 103. The flexible support members 101 may flex or bow into an essentially arcuate shape when exposed to lateral forces that deflect the area of the flexible support member 101 disposed between the top end 102 and the bottom end 103 while applying force to bring the top end 102 and the bottom end 103 in closer proximity to one another. When these forces are removed, the flexible support member 101 may return to its original, essentially planar shape.

Each flexible support member 101 may be connected to a pack 104 by a top capture 105 and a bottom capture 106. The top capture 105 or the bottom capture 106 may be a rivet, a snap, an adhesive, hooks and loops, a zipper, or any like fastener known to those skilled in the art. In one embodiment, the top capture 105 or bottom capture 106 may be constructed from fabric that is secured to the pack 104 on the left side and the right side of the flexible support member 101 and retains the flexible support member 101 against the pack 104. The fabric may be constructed from cotton, nylon, polyester, polyethylene, or the like. In another embodiment, the top capture 105 or bottom capture 106 may be constructed from fabric that is secured to the pack 104 on the left side and the right side of the flexible support member 101 as well as above the top end 102 for a top capture 105 and below the bottom end 103 for a bottom capture 106.

Figure 2A:
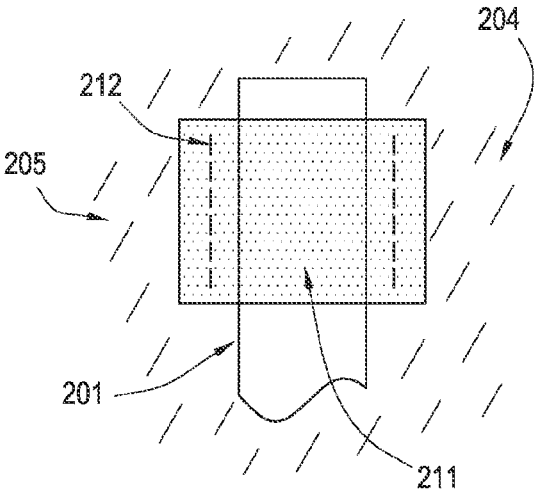
FIG. 2*a* is a drawing of one embodiment of the top capture.
Figure 2B:
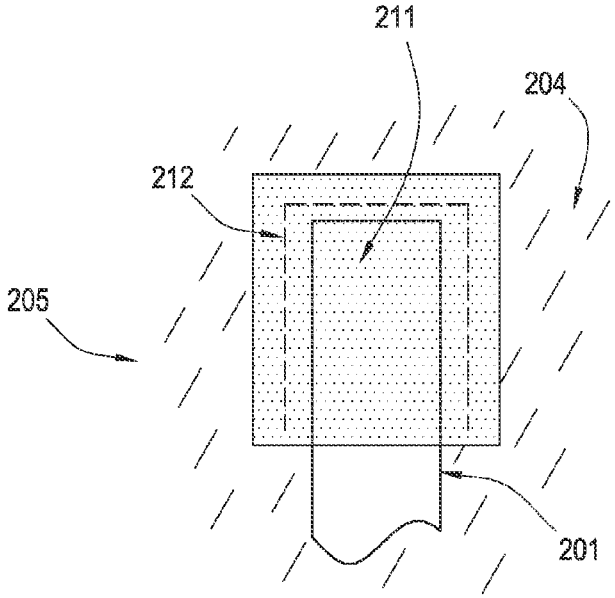
FIG. 2*b* is a drawing of another embodiment of the top capture.

FIG. 2*a* depicts one embodiment of a top capture 205 in which the flexible support member 201 is secured to the pack 204 by a piece of fabric 211 which is connected to the pack 204 by stitches 212 on either side of the flexible support member 201. FIG. 2*b* depicts an embodiment of the top capture 205 in which the flexible support member 201 is secured to the pack 204 by a piece of fabric 211 which is connected to the pack 204 by stitches 212 on either side of the flexible support member 201 and also above the flexible support member 201.

The top capture 105 or bottom capture 106 may removably connect the flexible support member 101 to the pack. This may be achieved by connection methods including, but not limited to, hooks and loops, snaps, rivets, buttons, zippers, pockets, or the like. In the embodiment depicted in FIGS. 3*a* and 3*b*, the flexible support member 201 may be removed from or inserted into the pocket formed by the connection of the fabric 211 to the pack 204.

Returning to FIG. 1, the pack 104 may be any backpack, duffel, purse, case, sack, or the like known in the art. In one embodiment of the inventive concept, the pack 104 may be a backpack with multiple pockets, straps, or other securing means for containing equipment. The backpack may have two shoulder straps that are worn across the wearer's shoulders. Each shoulder strap may connect to a low point and a high point on the backpack. The backpack may also have a waist strap that is secured to the wearer's waist and distributes a significant amount of the weight of the backpack and contents to the wearer's torso.

A tensioner 108 may connect to two tensioner attachment points 107. The tensioner 108 may be a rope-like structure constructed from a synthetic material that resists elongation when subject to tensile stress. Suitable materials for the tensioner 108 may include, but are not limited to, polyester, nylon, polyethylene, cotton, or the like. Materials with properties identical to or similar to brand name Dyneema® may be used to construct the tensioner 108. The tensioner 108 may have a tension length that is measured as the length of tensioner 108 disposed between the two tensioner attachment points 107 to which the tensioner 108 is connected.

A tensioner attachment point 107 may be disposed on the pack 104. The tensioner attachment point 107 may be disposed in close proximity to each top end 102 and each bottom end 103. The tensioner attachment point 107 may connect to the pack 104 at the same location as the top capture 105 or bottom capture 106. Two tensioner attachment points 107 may be disposed on the pack 104 for each flexible support member 101 that is present.

The tensioner 108 may be connected to the pack 104 in such a way that adjusting the length of the tensioner 108 may exert stress on the flexible support member 101 and shortening the tensioner 108 may cause the flexible support member 101 to bow away from the pack wearer's body. When the flexible support members 101 are bowed, they may support the weight of the pack 104 and its contents away from the wearer's body. Lateral force may be applied to the flexible support member 101 to deflect the midsection of the flexible support member 101 before the tensioner 108 may be shortened.

Figure 3:
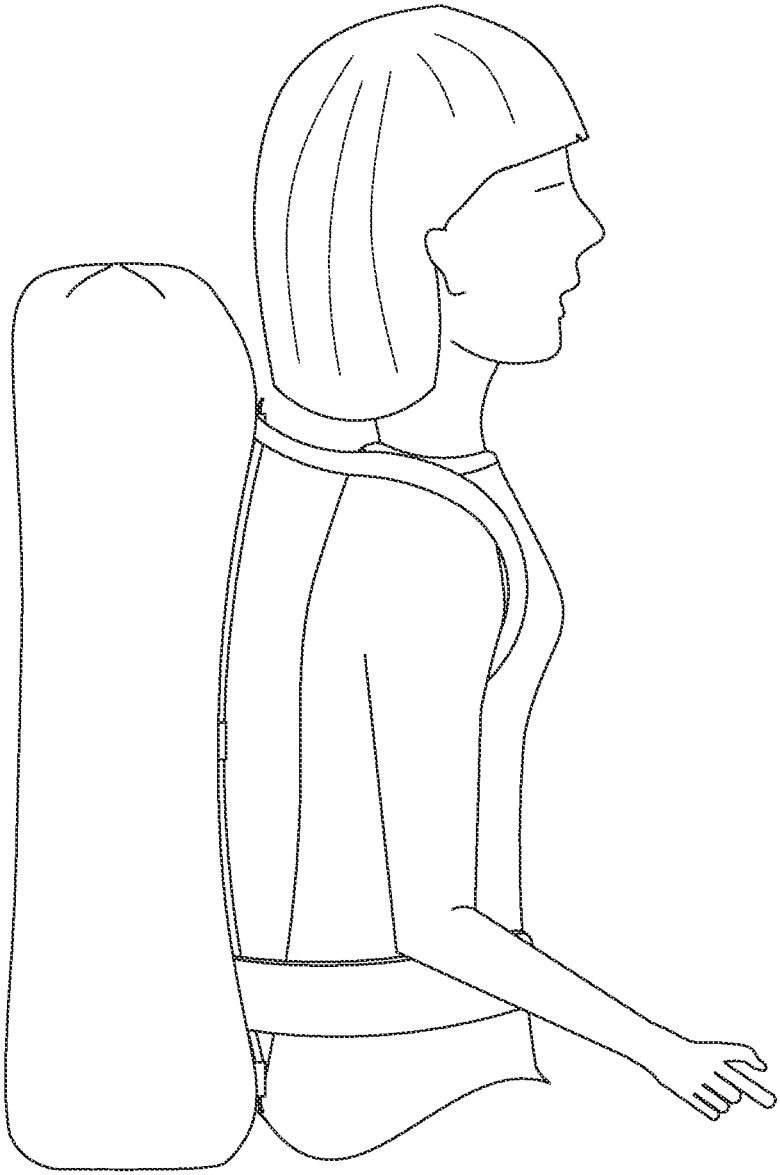
FIG. 3 is a drawing of the backpack frame on a wearer's back.

The tensioner length may be adjusted to manipulate the shape of the flexible support member 101 across which the tensioner 108 is disposed. When the tensioner length is at maximum length, which is any length longer than the length of the flexible support member 101 across which the tensioner 108 is disposed, the flexible support member 101 may maintain a substantially planar shape. When the tensioner length is adjusted to activating length, which is any length shorter than the length of the flexible support member 101 across which the tensioner 108 is disposed, the flexible support member 101 may be subject to forces that draw the top end 102 and the bottom end 103 closer together and cause the flexible support member 101 to assume an arcuate shape. FIG. 3 depicts the pack on a wearer's back with the tensioners 108 at the activating length.

The tensioner 108 may be connected to the tensioner attachment point 107 by threading the tensioner 108 through a first opening of an attachment apparatus and a second opening of an attachment apparatus. The tensioner 108 may pass through the first opening substantially 180° opposed to the direction at which it may pass through the second opening. The tensioner 108 may be secured in place by the attachment apparatus through friction, clamping, or the like. The tensioner length may be adjusted by pulling on either free end of the tensioner 108. The force exerted by the attachment apparatus may be removed from the tensioner 108 to allow the tension length to increase.

Figure 4:
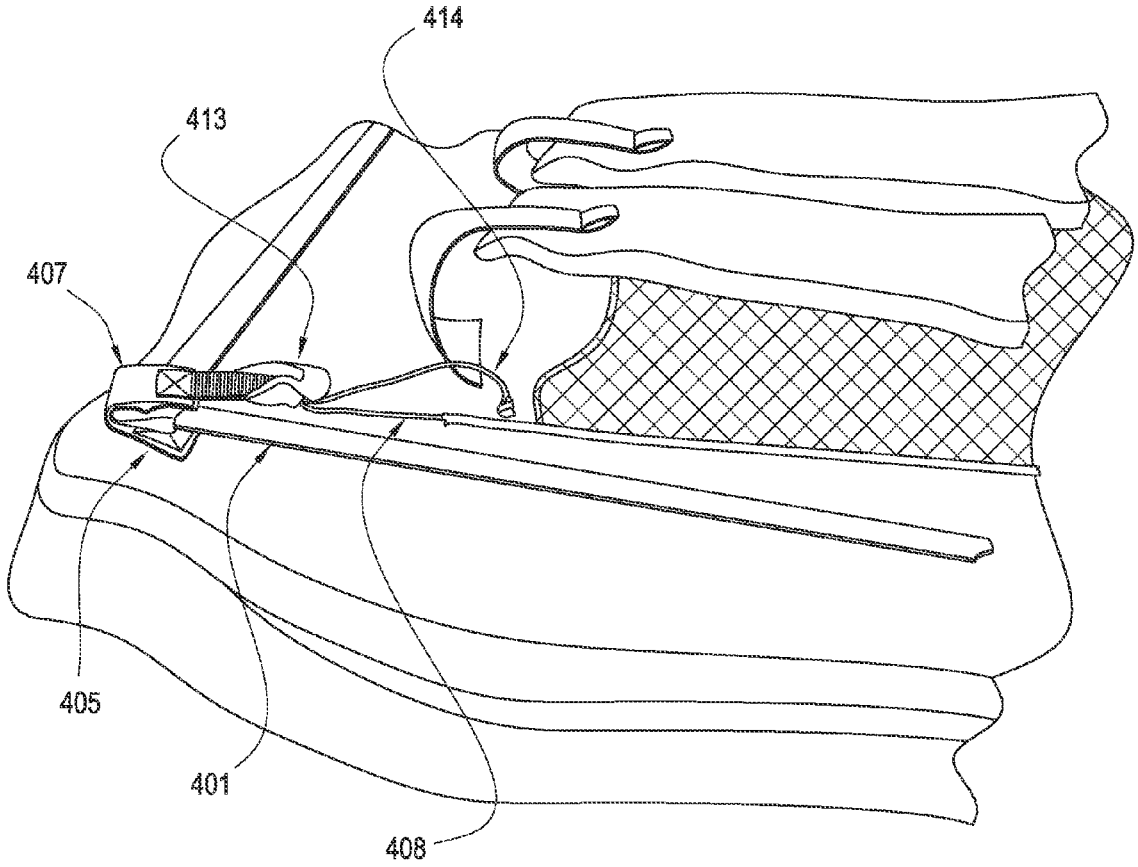
FIG. 4 is a drawing of the tensioner attachment point.

FIG. 4 depicts one embodiment of the tensioner attachment point 407 in more detail. The tensioner 408 is connected to the tensioner attachment point through an attachment apparatus 413. The free end 414 of the tensioner 408 may be pulled to shorten the tension length. The attachment apparatus 413 may be adjusted to lengthen the tension length. Lateral stress may be applied to the flexible support member 401 to allow the flexible support member 401 to flex and provide the ability to shorten the tension length. FIG. 4 depicts an embodiment of the tensioner attachment point 407 in proximity to the top capture 405. Embodiments of the tensioner attachment point 407 in proximity to the bottom capture may be identical or similar to that shown in FIG. 4.

Figure 5A:
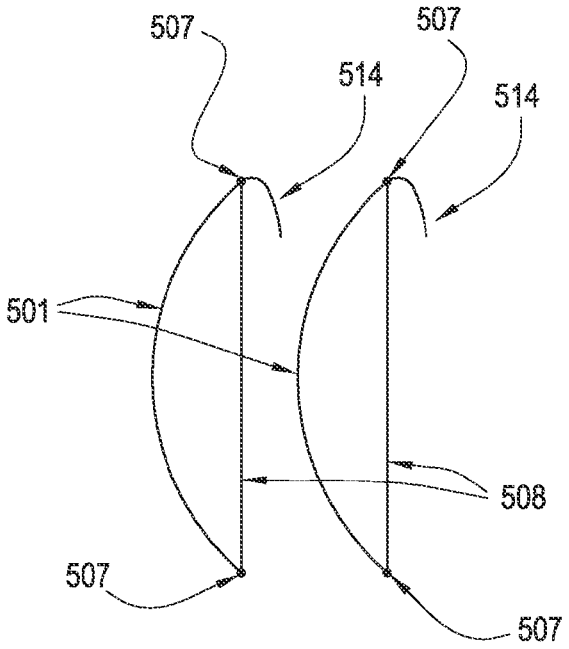
FIG. 5*a* is a drawing of the tensioner at the activating length.

FIG. 5*a* depicts the tensioners 508 adjusted to the activating length. When the tensioners 508 are at the activating length, the tension length is shorter than the length of the portion flexible support member 501 that is disposed between the two tensioner attachment points 507 that connect the tensioner 508 to the pack. The tension length may be shortened by pulling on the free end 514 of the tensioner 508. Adjusting the tensioner 508 to the activating length, may cause the flexible support member 501 to bow away from the tensioner 508.

Figure 5B:
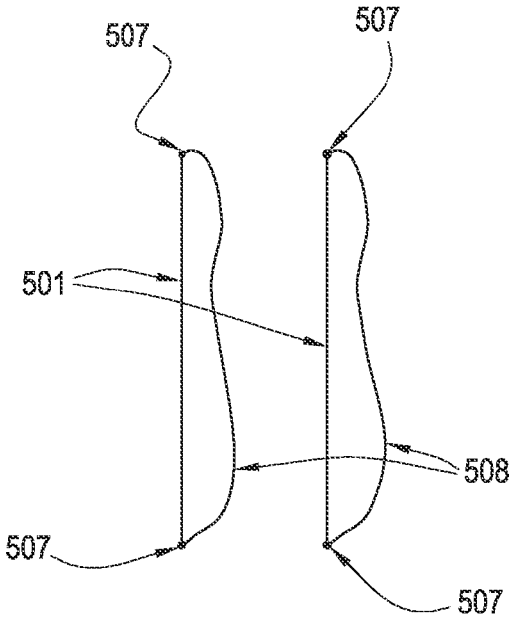
FIG. 5*b* is a drawing of the tensioner at the maximum length.

FIG. 5*b* depicts the tensioners 508 adjusted to the maximum length. When the tensioners 508 are at the maximum length, the tension length is longer than the length of the portion flexible support member 501 that is disposed between the two tensioner attachment points 507 that connect the tensioner to the pack.

In one embodiment of the inventive backpack frame 100, as depicted in FIG. 1, there may be two flexible support members 101, two tensioners 108, two top captures 105, two bottom captures 105, and four tensioner attachment points 107. In such an embodiment, the tension length of each tensioner 108 may be adjusted independently. In some embodiments, the tension length of each tensioner 108 may be adjusted dependent on each other.

In embodiments with two flexible support members 101, they may be disposed substantially parallel to one another. The two flexible support members 101 may be substantially identical in length. The top captures 105 may be disposed at substantially the same height on the pack 104 and the bottom captures may be disposed at substantially the same height on the pack 104.

A cross-member 109 may extend between two or more flexible support members 101. In embodiments utilizing a cross-member 109, the cross-member 109 may connect substantially orthogonally to each flexible support member 101. The cross-member 109 may be constructed from a material similar to that of the flexible support member 101. However, it may not be necessary for the cross-member 109 to flex. The cross-member 109 may be resiliently flexible or rigid. In some embodiments of the inventive backpack frame 100, a cross-member 109 may connect two flexible support members 101 at or near the top ends 102 while a second cross-member 109 may connect the two flexible support members 101 at or around their mid-points. The cross-member 109 may connect to the pack 104 and to the flexible support member 101 by attachment structures similar to the top capture 105 or bottom capture 106.

Figure 2C:
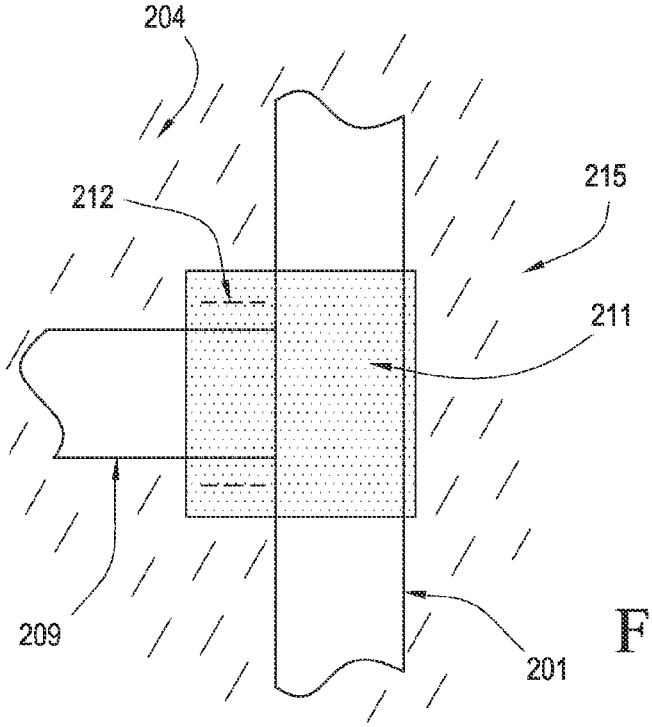
FIG. 2*c* is a drawing of a cross-member capture.

FIG. 2*c* depicts a cross-member capture 215. In this embodiment of the cross-member capture 215, the flexible support member 201 may be surrounded by the fabric 211. Alternatively the fabric 211 may extend over the flexible support member 201 and be secured to the pack 204 by stitching along the side of the flexible support member 201 that is opposed to the side of the flexible support member 201 that is adjacent to the cross-member 209. The fabric 211 may be secured to the pack 204 with stitches 212 along either side of the cross-member 209.

A mesh structure 110 may extend substantially between two or more tensioners 108. The mesh structure 110 may be substantially planar and provide a breathable surface to come into contact with a wearer's back when the backpack is in use. The mesh structure 110 may extend less than the entire length of the tensioner 108 and may be less than the shortest possible activating length. The mesh structure 110 may be removably attached to the tensioners 108. The mesh structure 110 may be an area of mesh, lightweight, or breathable fabric disposed between the tensioners 108.

The foregoing examples have been provided in the interest of clarity to illustrate an embodiment of the present invention in substantial detail. A person of skill in the art will appreciate that one or more of the above provided embodiments may be included in the use of the backpack frame of the present invention. Additionally, a person of skill in the art will appreciate additional embodiments that would be included within the scope and spirit of the present invention, after having the benefit of this disclosure. Furthermore, a skilled artisan will appreciate that the operations described above, along with additional operations that would be apparent to those in the art, may be performed exclusively, incrementally, sequentially, simultaneously, or any other operative configuration.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A backpack frame comprising:

a first flexible support member further comprising a first top end and a first bottom end;

a second flexible support member further comprising a second top end and a second bottom end;

a pack further comprising a first tensioner attachment point, a second tensioner attachment point, a third tensioner attachment point, and a fourth tensioner attachment point;

a first tensioner having a first tension length; and a second tensioner having a second tension length;

wherein the first tensioner is attached to the first tensioner attachment point;

wherein the first tensioner is attached to the second tensioner attachment point;

wherein the second tensioner is attached to the third tensioner attachment point;

wherein the second tensioner is attached to the fourth tensioner attachment point;

wherein the first flexible support member extends substantially between the first tensioner attachment point and the second tensioner attachment point;

wherein the second flexible support member extends substantially between the third tensioner attachment point and the fourth tensioner attachment point;

wherein the first tension length is located between the first tensioner attachment point and the second tensioner attachment point;

wherein the second tension length is located between the third tensioner attachment point and the fourth tensioner attachment point;

wherein the first tension length may be adjusted;

wherein the second tension length may be adjusted; and wherein the first flexible support member extends substantially parallel to the second flexible support member.

2. The backpack frame according to claim 1 further comprising:

a plurality of cross-members;

wherein each of the plurality of cross-members extends substantially orthogonally between the first flexible support member and the second flexible support member.

3. The backpack frame according to claim 1 wherein the plurality of cross-members further comprises a first cross-member and a second-cross-member.

4. The backpack frame according to claim 1 further comprising a mesh structure;

wherein the mesh structure is connected to the first tensioner; and wherein the mesh structure is connected to the second tensioner.

5. The backpack frame according to claim 1 wherein the first tensioner and the second tensioner remain substantially unelongated under strain.

6. The backpack frame according to claim 1 wherein the pack further comprises a first top capture, a second top capture, a first bottom capture, and a second bottom capture;

wherein the first top end is removably retained by the first top capture;

wherein the second top end is removably retained by the second top capture;

wherein the first bottom end is removably retained by the first bottom capture; and wherein the second bottom end is removably retained by the second bottom capture.

7. The backpack according to claim 1 wherein the first tension length has a first maximum length;

wherein the second tension length has a second maximum length;

wherein the first flexible support member maintains a substantially planar shape when the first tension length is the first maximum length; and wherein the second flexible support member maintains a substantially planar shape when the second tension length is the second maximum length.

8. The backpack according to claim 1 wherein the first tension length has a first activating length;

wherein the second tension length has a second activating length;

wherein the first flexible support member maintains a substantially arcuate shape when the first tension length is the first activating length; and wherein the second flexible support member maintains a substantially arcuate shape when the second tension length is the second activating length.

9. A method for adjusting a backpack frame comprising the steps of:

obtaining a pack, comprising a first tensioner attachment point, a second tensioner attachment point, a third tensioner attachment point, and a fourth tensioner attachment point, wherein a first tensioner is attached to the first tensioner attachment point and the second tensioner attachment point, wherein a second tensioner is attached to the third tensioner attachment point and the fourth tensioner attachment point, wherein a first tension length of the first tensioner is located between the first tensioner attachment point and the second tensioner attachment point, wherein a second tension length of the second tensioner is located between the third tensioner attachment point and the fourth tensioner attachment point;

attaching a first flexible support member, further comprising a first top end and a first bottom end, to the pack, wherein the first flexible support member is substantially disposed between the first tensioner attachment point and the second tensioner attachment point;

attaching a second flexible support member, further comprising a second top end and a second bottom end, to the pack, wherein the second flexible support member is substantially disposed between the third tensioner attachment point and the fourth tensioner attachment point;

adjusting the first tension length between a released first tension length and an activated first tension length wherein the first flexible support member maintains a substantially planar shape when the first tension length is the released first tension length and the first flexible support member maintains a substantially arcuate shape when the first tension length is the activated first tension length; and adjusting the second tension length between a released second tension length and an activated second tension length wherein the second flexible support member maintains a substantially planar shape when the second tension length is the released second tension length and the second flexible support member maintains a substantially arcuate shape when the second tension length is the activated second tension length.

* * * * *